US009721501B2

(12) United States Patent
Cho et al.

(10) Patent No.: US 9,721,501 B2
(45) Date of Patent: Aug. 1, 2017

(54) ORGANIC LIGHT-EMITTING DISPLAY PANEL, ORGANIC LIGHT-EMITTING DISPLAY APPARATUS, AND METHOD OF REPAIRING THE ORGANIC LIGHT-EMITTING DISPLAY PANEL

(71) Applicant: SAMSUNG DISPLAY CO., LTD., Yongin, Gyeonggi-Do (KR)

(72) Inventors: Young-Jin Cho, Yongin (KR); Deok-Young Choi, Yongin (KR); Young-In Hwang, Yonging (KR)

(73) Assignee: Samsung Display Co., Ltd., Yongin-si (KR)

( * ) Notice: Subject to any disclaimer, the term of this patent is extended or adjusted under 35 U.S.C. 154(b) by 77 days.

(21) Appl. No.: 14/476,614

(22) Filed: Sep. 3, 2014

(65) Prior Publication Data

US 2015/0294620 A1 Oct. 15, 2015

(30) Foreign Application Priority Data

Apr. 11, 2014 (KR) ..... 10-2014-0043682

(51) Int. Cl.
*G09G 3/3233* (2016.01)

(52) U.S. Cl.
CPC ... *G09G 3/3233* (2013.01); *G09G 2300/0426* (2013.01); *G09G 2320/0233* (2013.01); *G09G 2330/02* (2013.01); *G09G 2330/08* (2013.01); *G09G 2330/10* (2013.01)

(58) Field of Classification Search
CPC . G09G 3/3241; G09G 2330/10; G09G 3/3233
See application file for complete search history.

(56) References Cited

U.S. PATENT DOCUMENTS

| | | | | |
|---|---|---|---|---|
| 6,522,079 | B1 | 2/2003 | Yamada | |
| 2005/0162353 | A1* | 7/2005 | Kanda | G09G 3/3233 345/76 |
| 2007/0075944 | A1* | 4/2007 | Shibusawa | G09G 3/325 345/84 |
| 2009/0102829 | A1* | 4/2009 | Abe | G09G 3/325 345/214 |
| 2010/0188391 | A1 | 7/2010 | Kim | |

(Continued)

FOREIGN PATENT DOCUMENTS

| | | |
|---|---|---|
| JP | 2001-109405 | 4/2001 |
| KR | 10-0986846 | 10/2010 |

(Continued)

*Primary Examiner* — Benjamin C Lee
*Assistant Examiner* — David Lee
(74) *Attorney, Agent, or Firm* — Lewis Roca Rothgerber Christie LLP

(57) ABSTRACT

An organic light-emitting display panel including a plurality of pixels arranged at a display area in column and row directions, the plurality of pixels being configured to receive power voltages; a voltage line associated with a pixel column, the voltage line being configured to apply a power voltage to the plurality of pixels included in the pixel column, the power voltage being supplied from a power line; and an auxiliary line coupled to a center node of the voltage line, the center node being located at a middle point of the voltage line, wherein the power voltage supplied from the power line is configured to be applied to the voltage line through the center node.

19 Claims, 11 Drawing Sheets

(56) References Cited

U.S. PATENT DOCUMENTS

| | | | | |
|---|---|---|---|---|
| 2011/0260630 | A1* | 10/2011 | Tsai | H05B 33/0896 315/160 |
| 2012/0050344 | A1 | 3/2012 | Kim et al. | |
| 2012/0286298 | A1* | 11/2012 | Pang | H01L 51/5203 257/88 |
| 2012/0319930 | A1* | 12/2012 | Yamamoto | G09G 3/3233 345/76 |
| 2013/0032806 | A1* | 2/2013 | Kimura | H01L 27/1255 257/59 |
| 2015/0294612 | A1 | 10/2015 | Kim et al. | |

FOREIGN PATENT DOCUMENTS

| | | |
|---|---|---|
| KR | 10-2011-0019589 | 2/2011 |
| KR | 10-2012-0019016 | 3/2012 |
| KR | 10-2015-0117357 | 10/2015 |

* cited by examiner

ORGANIC LIGHT-EMITTING DISPLAY PANEL, ORGANIC LIGHT-EMITTING DISPLAY APPARATUS, AND METHOD OF REPAIRING THE ORGANIC LIGHT-EMITTING DISPLAY PANEL

CROSS-REFERENCE TO RELATED APPLICATION

This application claims priority to and the benefit of Korean Patent Application No. 10-2014-0043682, filed on Apr. 11, 2014, in the Korean Intellectual Property Office, the disclosure of which is incorporated herein in its entirety by reference.

BACKGROUND

1. Field

One or more embodiments of the present invention relate to organic light-emitting display panels, organic light-emitting display apparatuses, and methods of repairing an organic light-emitting display panel.

2. Description of the Related Art

An organic light-emitting display apparatus displays images by using (utilizing) organic light-emitting diodes that emit light by recombination of electrons and holes. The organic light-emitting display apparatus has a fast response time and power consumption thereof is low.

The organic light-emitting display apparatus includes a plurality of data lines, a plurality of scan lines, a plurality of power lines, and a plurality of pixels that are connected to the data, scan, and power lines and are arranged in a matrix configuration. Pixels of an organic light-emitting display apparatus operating in an analog driving mode represent gray scales by adjusting brightness thereof according to the sizes of an input voltage or current data. Pixels of an organic light-emitting display apparatus operating in a digital driving mode represent gray scales by emitting light for different periods of time while emitting light with the same brightness. A voltage drop (or IR drop) occurs in the power lines due to resistance components of the power lines and relatively large currents flowing through the power lines. Depending on the positions of the pixels, different voltage levels of power voltages are applied to the pixels, and the pixels may not emit light with desired brightness due to the different voltage levels. In particular, in the organic light-emitting display apparatus operating in the digital driving mode, a luminance deviation due to the voltage drop of the power lines is a serious problem.

When a defect occurs in a pixel of the organic light-emitting display apparatus, the pixel may always emit light regardless of a scan signal and a data signal. The pixel which always emit light is seen as a bright spot by a viewer, and the bright spot is easily observed by the viewer due to its high visibility. Therefore, in the related art, a defective pixel having a bright spot with high visibility is repaired to have a dark spot, thereby reducing the visibility of the defective pixel.

SUMMARY

Aspects of one or more embodiments of the present invention are directed toward organic light-emitting display panels, organic light-emitting display apparatuses, and methods of repairing an organic light-emitting display panel.

Additional aspects will be set forth in part in the description which follows and, in part, will be apparent from the description, or may be learned by practice of the presented embodiments.

According to one or more embodiments of the present invention, an organic light-emitting display panel is described including: a plurality of pixels arranged at a display area in column and row directions, the plurality of pixels being configured to receive power voltages; a voltage line associated with a pixel column, the voltage line being configured to apply a power voltage to the plurality of pixels included in the pixel column, the power voltage being supplied from a power line; and an auxiliary line coupled to a center node of the voltage line, the center node being located at a middle point of the voltage line, wherein the power voltage supplied from the power line is applied to the voltage line through the center node.

The power line may be located outside of the display area, and one end or both ends of the voltage line may be coupled to the power line.

The organic light-emitting display panel may further include a dummy pixel located outside of the display area, wherein the auxiliary line may be associated with the pixel column and is configured to be connectable to the dummy pixel and one pixel of the plurality of pixels included in the pixel column.

A connection between the voltage line and the auxiliary line at the center node may be disconnectable.

The auxiliary line may be coupled to the power line or an edge node of the voltage line, the edge node being located at one end or both ends of the voltage line, and a connection between the voltage line and the auxiliary line at the edge node or a connection between the power line and the auxiliary line may be disconnectable.

The voltage line may be associated with a plurality of pixel columns, the voltage line being configured to apply the power voltage to the plurality of pixels included in the plurality of pixel columns.

The voltage line may be provided as a plurality of voltage lines, each associated with every two adjacent pixel columns of the plurality of columns.

The auxiliary line may be provided as a plurality of auxiliary lines, and wherein the plurality of voltage lines and the plurality of auxiliary lines may be provided alternately for the plurality of pixel columns.

The auxiliary line may be coupled to the voltage line at an edge node, the edge node being located at one end of the voltage line, and wherein the auxiliary line is configured to supply a voltage of the edge node to the voltage line through the center node.

The auxiliary line may have a lower linear resistance than the voltage line.

The auxiliary line may be thicker than the voltage line.

The voltage line may include a circuit element between the power line and the plurality of pixels, and the circuit element may have a resistance.

The resistance of the circuit element may correspond to a resistance between a node coupled to the center node and a node coupled to the power line at an intersection of the power line and the auxiliary line.

According to another embodiments of the present invention, a method of repairing an organic light-emitting display panel is described, including a plurality of pixels arranged at a display area in column and row directions, the plurality of pixels being configured to receive power voltages; a dummy pixel located outside of the display area; a voltage line associated with a pixel column, the voltage line being configured to apply a power voltage to the plurality of pixels included in the pixel column, the power voltage being supplied from a power line; and an auxiliary line coupled to a center node of the voltage line, wherein the power voltage supplied from the power line is applied to the voltage line through the center node, wherein the auxiliary line is configured to couple the dummy pixel and one of the plurality of pixels included in the pixel column, the center node being located at a middle point of the voltage line, the method including: disconnecting a pixel circuit from a light-emitting element of a defective pixel from among the plurality of pixels; coupling the auxiliary line with the light-emitting element of the defective pixel; and applying a same data signal to the dummy pixel and the defective pixel coupled to the auxiliary line, and coupling a dummy pixel circuit of the dummy pixel to the auxiliary line to supply a driving current corresponding to the data signal to the light-emitting element of the defective pixel through the auxiliary line.

The method may further include disconnecting a connection between the auxiliary line and the voltage line at the center node.

The auxiliary line may be coupled to the power line or an edge node of the voltage line, the edge node being located at one end or both ends of the voltage line, the method further comprising disconnecting a connection between the voltage line and the auxiliary line at the edge node or a connection between the power line and the auxiliary line.

According to another embodiments of the present invention, an organic light-emitting display apparatus may include: a power voltage generator configured to provide a power voltage to a power line; a plurality of pixels arranged at a display area in column and row directions, the plurality of pixels being configured to receive power voltages; a voltage line associated with a pixel column, the voltage line being configured to apply a power voltage to the plurality of pixels included in the pixel column, the power voltage being supplied from a power line; and an auxiliary line coupled to a center node of the voltage line, the center node being located at a middle point of the voltage line, wherein the power voltage supplied from the power line is applied to the voltage line through the center node.

The power voltage generator may be configured to generate a first power voltage and a second power voltage, and provide the first power voltage to a first power line, and provide the second power voltage to a second power line, the voltage line is configured to receive the first power voltage from the first power line, and the auxiliary line is configured to receive the second power voltage from the second power line.

The second power voltage may be higher than the first power voltage.

A difference between the first power voltage and the second power voltage may correspond to a voltage drop at the auxiliary line when the power voltage is transferred from the power line to the center node.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
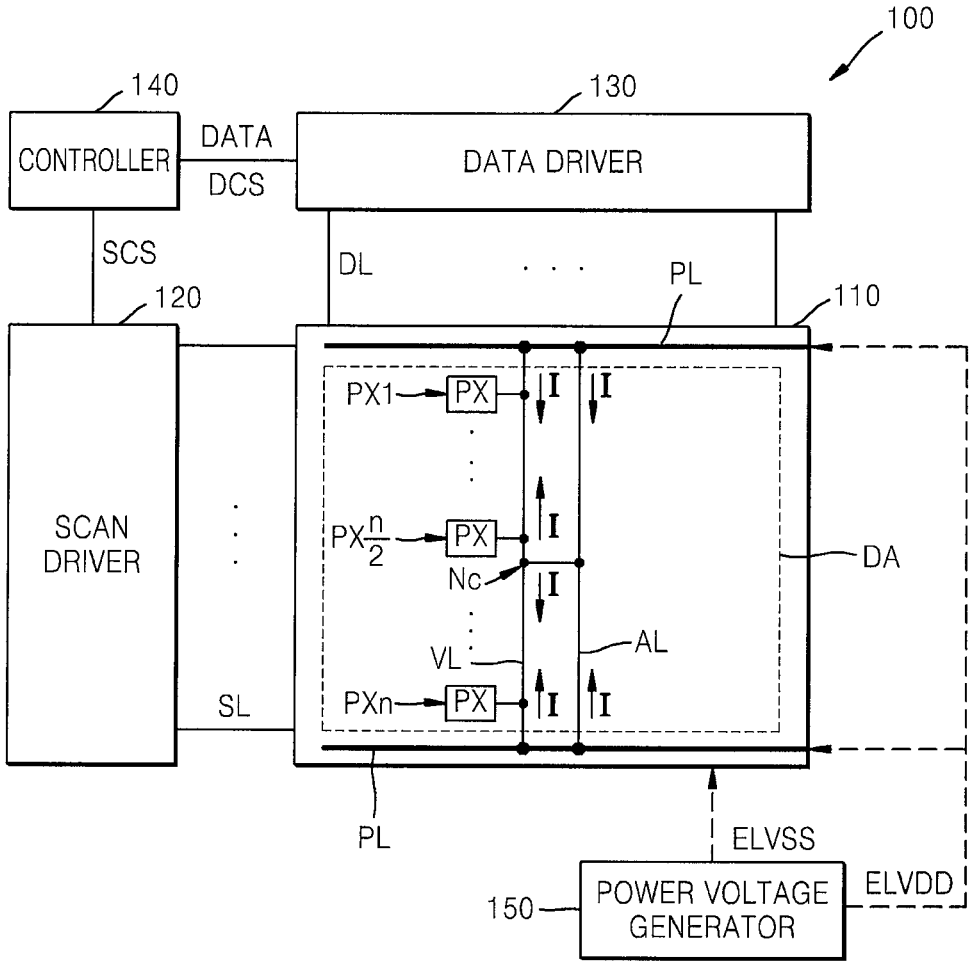
FIG. 1 schematically illustrates an organic light-emitting display apparatus according to an embodiment of the present invention.

Reference will now be made in more detail to various embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

The present invention may include various embodiments and modifications, and example embodiments thereof are illustrated in the drawings and will be described herein in detail. The effects and features of the present invention and the accomplishing methods thereof will become apparent from the following description of the embodiments, taken in conjunction with the accompanying drawings. However, the present invention is not limited to the embodiments described below, and may be embodied in various modes.

Hereinafter, embodiments of the present invention will be described in more detail with reference to the accompanying drawings. In the following description, like reference numerals denote like elements, and a redundant description thereof will be omitted.

It will be understood that although the terms "first", "second", etc. may be used herein to describe various components, these components should not be limited by these terms. These terms are only used to distinguish one component from another. As used herein, the singular forms "a", "an", and "the" are intended to include the plural forms as well, unless the context clearly indicates otherwise. It will be further understood that the terms "comprise", "include" and "have" used herein specify the presence of stated features or components, but do not preclude the presence or addition of one or more other features or components. When a first element is described as being "coupled" or "connected" to a second element, the first element may be directly coupled or connected to the second element, or indirectly coupled or connected with one or more intervening elements therebetween. Sizes of components in the drawings may be exaggerated for convenience of description. In other words, because sizes and thicknesses of components in the drawings are arbitrarily illustrated for convenience of description, the following embodiments are not limited thereto. When a certain embodiment may be implemented differently, a specific process order may be performed differently from the described order. For example, two consecutively described processes may be performed substantially at the same time or performed in an order opposite to the described order.

FIG. 1 schematically illustrates an organic light-emitting display apparatus 100 according to an embodiment of the present invention.

Referring to FIG. 1, the organic light-emitting display apparatus 100 includes a display panel 110, a scan driver 120, a data driver 130, a controller 140, and a power voltage generator 150.

According to an embodiment, the display panel 110 may operate in a digital driving mode and includes pixels PX, scan lines SL, data lines DL, a voltage line VL, and an auxiliary line AL.

The display panel 110 includes a display area DA in which the pixels PX are arranged in a matrix configuration in column and row directions. Each of the data lines DL is coupled to pixels PX of the same column to transfer a data signal to the pixels PX of the same column. Each of the scan lines SL is coupled (e.g., connected) to pixels PX of the same row to transfer a scan signal to the pixels PX of the same row.

A first power voltage ELVDD and a second power voltage ELVSS are applied to the pixels PX. A voltage level of the first power voltage ELVDD is higher than a voltage level of the second power voltage ELVSS. For example, when the first power voltage ELVDD is applied to an anode of an organic light-emitting element and the second power voltage ELVSS is applied to a cathode thereof, the organic light-emitting element emits light. The first power voltage ELVDD and the second power voltage ELVSS are generated by the power voltage generator 150. Herein, the term "power voltage" refers to the first power voltage.

Each of voltage lines VL is provided to correspond to a pixel column and transfers the power voltage to the pixels PX of the same column. Although FIG. 1 illustrates that the voltage lines VL are provided to correspond to pixel columns, the voltage lines VL may be provided to correspond to pixel rows. In this case, each of the voltage lines VL may be coupled to pixels PX of the same row to transfer the power voltage to the pixels PX of the same row.

The auxiliary line AL compensates for a voltage non-uniformity caused by a voltage drop of the voltage line VL. For example, the auxiliary line AL is coupled to a center node Nc, which is located at a middle point of the voltage line VL, and applies a power voltage supplied from a power line PL to the voltage line VL through the center node Nc.

If there is no auxiliary line AL, or if the auxiliary line AL does not apply the power voltage to the voltage line VL, a power voltage level on the voltage line VL decreases toward the center of the display panel 110. Because the power line PL supplying the power voltage to the voltage line VL is outside of the display area DA, a voltage drop due to current is gradually accumulated and the power voltage level decreases away from the outside of the display area DA. In order to compensate for this, the auxiliary line AL applies the power voltage supplied from the power line PL to the center node Nc of the voltage line VL.

In order to reduce or minimize a voltage drop on the auxiliary line AL, the auxiliary line AL may have a lower resistance than the voltage line VL. For example, the auxiliary line AL and the voltage line VL may be formed of different materials. The auxiliary line AL may be formed to be thicker than the voltage line VL.

The second power voltage ELVSS is applied to the pixels PX through a common electrode. The common electrode may correspond to one electrode (e.g., cathode) of the light-emitting element of the pixels PX and all of the pixels PX may be coupled to the common electrode. The common electrode may be formed to cover the pixels PX on the display area DA, but embodiments of the present invention are not limited thereto.

The power line PL is provided outside of the display area DA. The power line PL transfers the power voltage generated by the power voltage generator 150 to the voltage line VL and the auxiliary line AL. The first power voltage ELVDD generated by the power voltage generator 150 may be directly applied to the power line PL. The power line PL may have a low resistance, and thus, it may be assumed that a voltage drop caused by a current flowing through the power line PL is negligibly small. The power line PL is coupled to one end or both ends of the voltage line VL.

Although one voltage line VL and one auxiliary line AL are illustrated in FIG. 1, a plurality of voltage lines VL and a plurality of auxiliary lines AL may be arranged on the display panel 110 and may be coupled to the power line PL.

FIG. 1 illustrates that the power line PL is located at a top end and a bottom end of the display area DA. However, according to some embodiments, the power line PL may be located on the left side and/or the right side of the display area DA or may surround the display area DA. Although FIG. 1 illustrates that the same first power voltage ELVDD is supplied to a plurality of power lines PL, a plurality of different first power voltages ELVDD may be generated by the power voltage generator 150 and respectively supplied to the plurality of power lines PL.

FIG. 1 illustrates that the power line PL is formed of wiring. However, embodiments of the present invention are not limited thereto, and a film line or a pad may be provided instead of the power line PL.

Referring to FIG. 1, a current flow direction in the voltage line VL and the auxiliary line AL is represented by an arrow. Because a voltage drop occurs according to a current flow, a voltage drop occurs according to the arrow direction in the voltage line VL and the auxiliary line AL.

Referring to FIG. 1, the controller 140 receives image data from the outside (e.g., from the outside of the controller 140) and controls the scan driver 120 and the data driver 130. The controller 140 generates a plurality of control signals SCS and DCS and digital data DATA. The controller 140 provides a first control signal SCS to the scan driver 120 and also provides a second control signal DCS and digital data DATA to the data driver 130. Hereinafter, the first control signal SCS may be referred to as a scan control signal, and the second control signal DCS may be referred to as a data control signal.

The scan driver 120 drives the scan lines SL according to a predetermined (or set) order in response to the first control signal SCS. For example, the scan driver 120 may generate a scan signal S and provide the scan signal S to the pixels PX through the scan line SL.

The data driver 130 drives the data lines DL in response to the second control signal DCS and the digital data DATA. The data driver 130 may generate data signals respectively corresponding to the data lines DL and provide the data signals to the pixels PX through the data lines DL.

The data signal may be a digital signal having an on-level or an off level, and the pixel PX receiving the digital signal emits light or does not emit light depending on a logic level of the digital signal. In the described embodiment, it is assumed that the pixel emits light when the digital data signal has an on-level, and does not emit light when the digital data signal has an off level. The on-level may be a high level (e.g., a logic high), depending on a circuit configuration of the pixel PX. In another example embodiment, the on-level may be a low level (e.g., a logic low).

Hereinafter, embodiments of the present invention will be described based on an example case where the organic light-emitting display apparatus 100 operates in a digital driving mode. Accordingly, the state of the light-emitting element of the pixel PX has an emission state and a non-emission state, and the light-emitting luminance of the light-emitting element is determined according to the voltage levels of the first power voltage and the second power voltage. However, embodiments of the present invention may also be applied to an organic light-emitting display apparatus that operates in an analog driving mode. When the organic light-emitting display apparatus 100 operates in a digital driving mode, one frame includes a plurality of subfields and a length of each subfield (e.g., a display duration time) is determined according to a weight set in each subfield. Each subfield may include an image signal having an on-level or an off level.

Each of the pixels PX may include a pixel circuit and a light-emitting element coupled to the pixel circuit. The pixel PX will be described in more detail later with reference to FIG. 5A.

Figure 2:
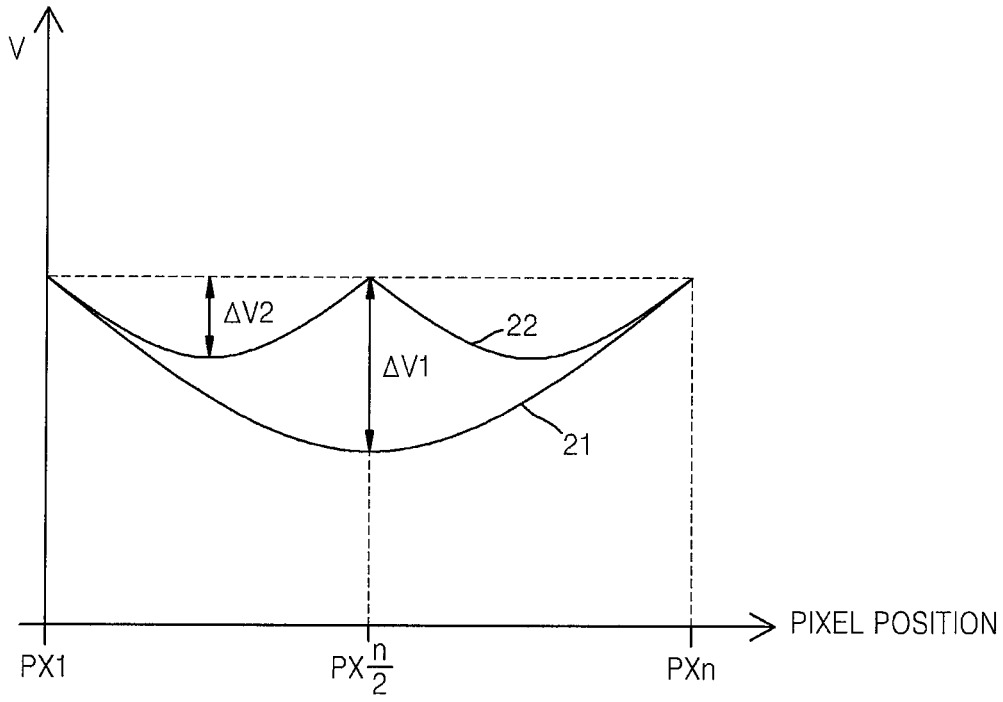
FIG. 2 illustrates a voltage level change of a power voltage applied to pixels, depending on pixel positions in a display panel illustrated in FIG. 1.

FIG. 2 illustrates a voltage level change of the power voltage ELVDD applied to the pixels PX, depending on pixel positions in the display panel 110 illustrated in FIG. 1.

Referring to FIG. 2, a graph 21 represents a level change of the power voltage ELVDD in a case where there is no auxiliary line AL (or in a case where the auxiliary line AL is not coupled to the center node Nc of the voltage line VL), and a graph 22 represents a level change of the power voltage ELVDD in a case where the auxiliary line AL is coupled to the center node Nc of the voltage line VL.

In the graph 21, a level of the power voltage ELVDD applied to the pixels PX of the same column coupled to the same voltage line VL has a maximum value at the first pixel PX1 and the nth pixel PXn coupled to an end portion of the voltage line VL and has a minimum value at the center pixel PXn/2. However, in the graph 22, when the auxiliary line AL applies the power voltage to the center node Nc located near the center pixel PXn/2, a level of the power voltage ELVDD applied to the center pixel PXn/2 is identical to or similar to a level of the power voltage ELVDD applied to the first pixel PX1 and the nth pixel PXn.

In the graph 21, a deviation of the maximum value and the minimum value of the level of the power voltage ELVDD is $\Delta V1$, and in the graph 22, a deviation of the maximum value and the minimum value of the level of the power voltage ELVDD is $\Delta V2$. Referring to the graph 21 and the graph 22, $\Delta V2$ is smaller than $\Delta V1$. The light-emitting luminance of the light-emitting element of the pixel PX is proportional to or corresponds to the level of the power voltage applied to the pixel PX. Thus, in the case of the graph 22, that is, in the case where the auxiliary line AL is coupled to the center node Nc of the voltage line VL, a deviation of the light-emitting luminance of each pixel PX is improved (e.g., reduced).

Embodiment 1

Figure 3:
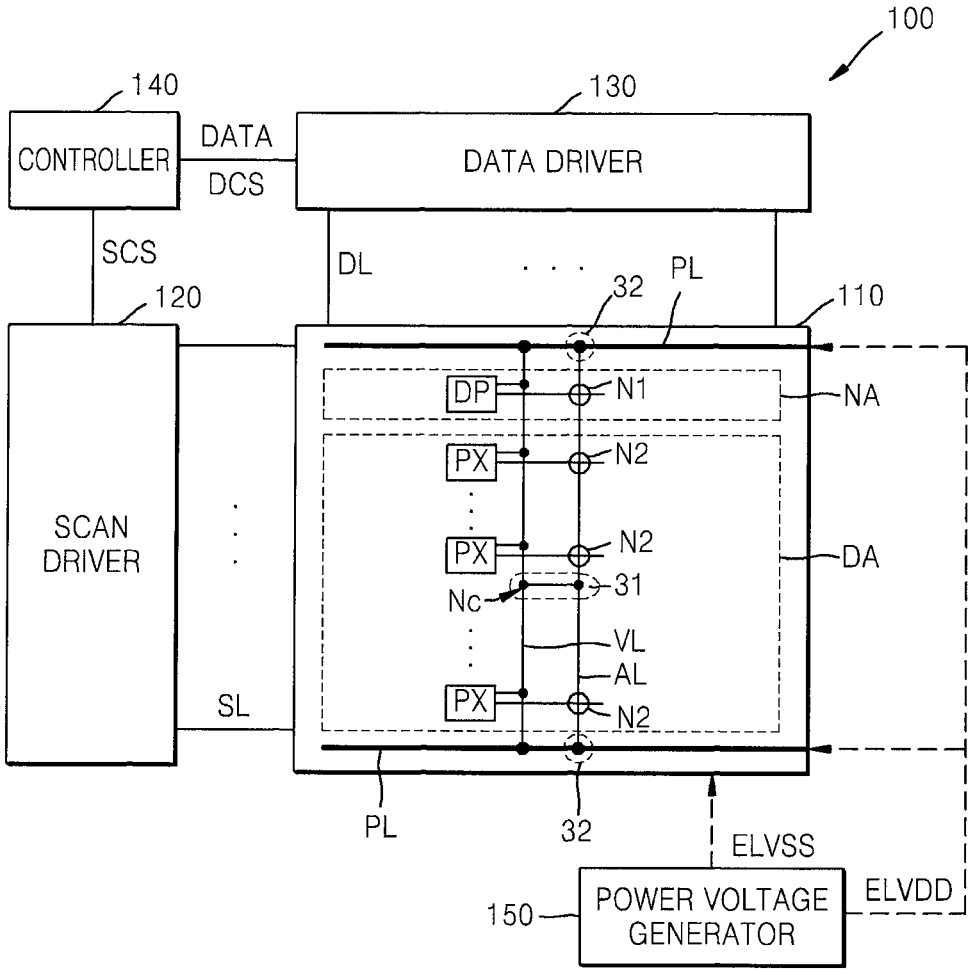
FIG. 3 schematically illustrates an example of the organic light-emitting display apparatus.

FIG. 3 schematically illustrates an example of the organic light-emitting display 100 apparatus.

According to an embodiment, the auxiliary line AL may be used (utilized) to repair a defective pixel of the display panel 110. In more detail, the auxiliary line AL is provided to correspond to a pixel column and may be used to repair one of the pixels PX included in the pixel column. The auxiliary line AL may be used to apply the power voltage to the center node Nc of the voltage line VL or to repair the defective pixel. When the auxiliary line AL is used to repair the defective pixel, a connection between the auxiliary line AL and the voltage line VL may be uncoupled.

Referring to FIG. 3, the display panel 110 includes a dummy pixel DP provided in a non-display area NA. The dummy pixel DP is coupled to the data line DL and the scan line SL and may be used to repair the defective pixel. When the dummy pixel DP is used to repair the defective pixel, the dummy pixel DP replaces a pixel circuit of the defective pixel. The auxiliary line AL may repair the defective pixel by coupling the defective pixel from among the pixels PX included in the pixel column to the dummy pixel DP.

Except for a time point when the scan driver 120 of FIG. 1 applies the scan signal to the dummy pixel DP, the controller 140 of FIG. 1 may control the data driver 130 of FIG. 1 to apply a data signal (which is identical to the data signal that is applied to the defective pixel when the scan signal is applied to the dummy pixel DP) to the dummy pixel DP.

The non-display area NA may be provided outside of the display area DA. The non-display area NA may be formed in at least one of the top, the bottom, the left and the right of the display area DA. For example, one or more dummy pixels DP may be formed in at least one of the top and bottom regions of each pixel column, or may be formed in at least one of the left and right regions of each pixel row. FIG. 3 illustrates an example in which the non-display area NA is provided over the display area DA (or at the top of the display area DA) and the dummy pixel DP is formed corresponding to the pixel column. However, the description related to FIG. 3 may also be similarly applied to a case where the dummy pixel DP is formed at the bottom, the left, or the right side of the display area DA or in the pixel column or row of the non-display area NA.

The auxiliary line AL includes a plurality of connectable nodes. Herein, the connectable node refers to a node that is not currently coupled but may be coupled later through a process (e.g., a simple process). For example, the connectable node may have a structure in which two conductors overlap each other with an insulating layer interposed therebetween. In this case, the two conductors may be electrically coupled by welding (e.g., welding out a portion of the insulating layer and welding in an electrical connection) between the two conductors by using laser or the like. However, detailed design of the connectable node is not limited thereto. The connectable node may be coupled (e.g., by welding out the insulating layer) during a repair process.

The auxiliary line AL includes a first connectable node N1 that is connectable to the dummy pixel DP and second connectable nodes N2 that are connectable to each of the pixels PX included in the pixel column. A connector 31 between the auxiliary line AL and the voltage line VL at the center node Nc and a connector 32 between the auxiliary line AL and the power line PL are provided to be disconnectable.

When the connectable nodes N1 and N2 of the auxiliary line AL are coupled and the connectors 31 and 32 are disconnected, the auxiliary line AL does not apply the power voltage to the voltage line VL anymore and the auxiliary line AL may be used to repair the defective pixel. This will be described in more detail below with reference to FIG. 4.

Figure 4:
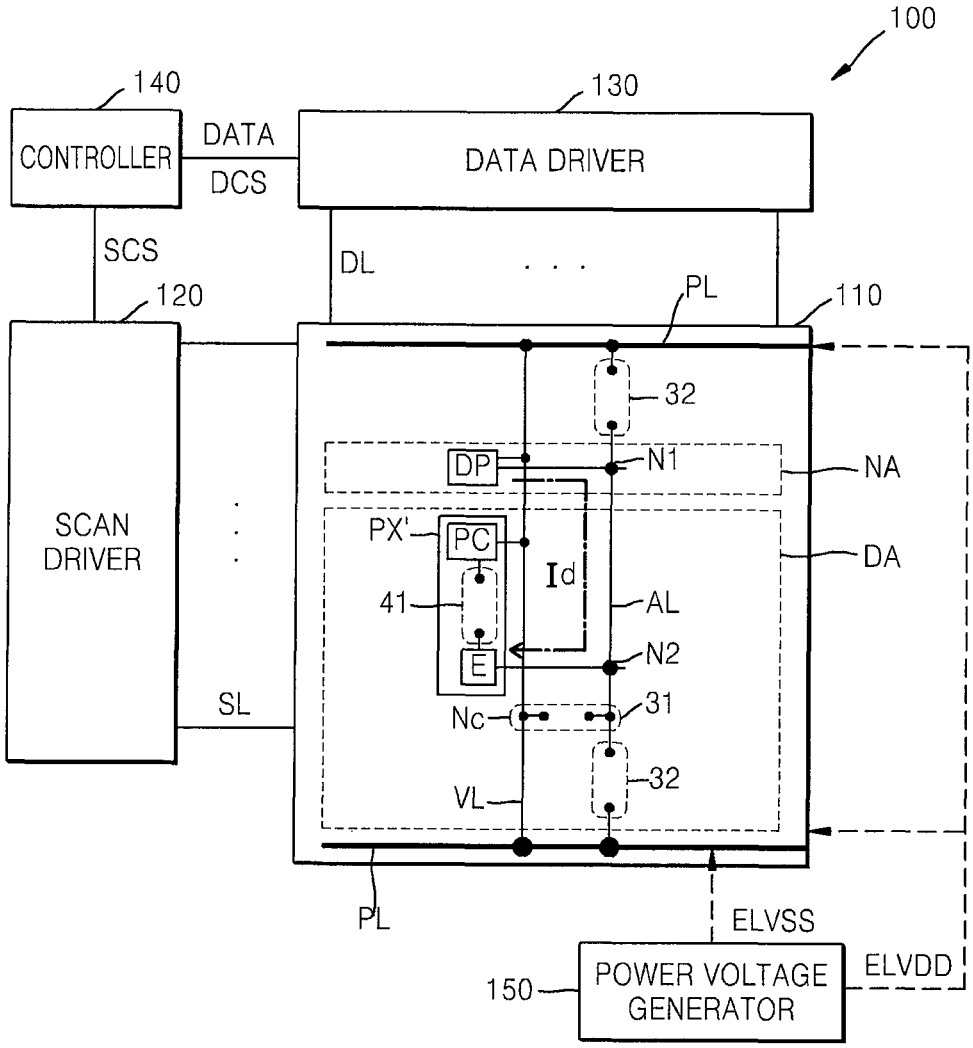
FIG. 4 schematically illustrates a method of repairing a defective pixel in the organic light-emitting display apparatus illustrated in FIG. 3.

FIG. 4 illustrates a method of repairing a defective pixel in the organic light-emitting display apparatus 100 illustrated in FIG. 3.

Referring to FIG. 4, the pixel PX formed in the display area DA may include a pixel circuit PC that is coupled to the scan line SL and the data line DL and a light-emitting element E that emits light by receiving a driving current from the pixel circuit PC. The dummy pixel DP formed in the non-display area NA may not include a light-emitting element E and may include a dummy pixel circuit that is coupled to the scan line SL and the data line DL.

However, the dummy pixel DP may include a light-emitting element depending on the design of embodiments of the present invention. When the dummy pixel DP includes a light-emitting element, the light-emitting element may function as a circuit element without actually emitting light. For example, the light-emitting element may function as a capacitor. Hereinafter, the described embodiments will be based on an example case where the dummy pixel DP includes only the dummy pixel circuit DPC. However, the structure of the dummy pixel DP in the embodiments of the present invention is not limited thereto.

Referring to FIG. 4, when a defective pixel PX' is detected, the auxiliary line AL may be used to repair the defective pixel PX'. The defective pixel PX' may be detected through a panel test for the display panel 110 after completion of the display panel 110. The panel test includes, for example, an on/off test, an aging test, and the like. The defective pixel PX' may be a pixel that is recognized as a bright spot or a dark spot regardless of a data signal, and may be caused by a defect of the pixel circuit PC included in the pixel.

When a defective pixel PX' is detected, a light-emitting element E of the defective pixel PX' is disconnected from the pixel circuit PC and the light-emitting element E is coupled to the dummy pixel DP through the auxiliary line AL. The disconnection of the light-emitting element E from the pixel circuit PC may be performed by cutting a connector 41 between the light-emitting element E and the pixel circuit PC. For example, the cutting may be performed by a laser beam irradiated from a substrate side or a side opposite to a substrate, but is not limited thereto.

The connection between the auxiliary line AL and the light-emitting element E and the connection between the auxiliary line AL and the dummy pixel DP may be established by shorting two conductors in the connectable nodes N1 and N2. However, because a detailed structure of the connectable nodes N1 and N2 may vary, shorting of two conductors may be replaced by a process of forming and welding a new conductor.

For example, the connectable node N1 may have a structure in which the auxiliary line AL and a conductor extending from the dummy pixel circuit DPC of the dummy pixel DP overlap each other with at least one insulating layer interposed therebetween. The conductor may be coupled to an output terminal of a driving transistor of the dummy pixel circuit DPC. The connectable node N1 may have a structure in which the auxiliary line AL and a conductor extending from the light-emitting element E of the pixel PX overlap each other with at least one insulating layer interposed therebetween. The conductor may be coupled to an anode of the light-emitting element E.

The connection between the auxiliary line AL and the light-emitting element E and the connection between the auxiliary line AL and the dummy pixel DP may be obtained by connecting the connectable nodes N1 and N2. For example, the conductor and the auxiliary line AL may be electrically coupled by welding (e.g., welding out a portion of the insulting layer and welding in an electrical connection) between the conductor and the auxiliary line AL in the connectable nodes N1 and N2.

As illustrated in FIG. 4, when the auxiliary line AL is used to repair the defective pixel PX1, the connection between the auxiliary line AL and the voltage line VL may be disconnected. For example, the center node Nc of the voltage line VL and the connector 31 of the auxiliary line AL may be disconnected, and the connector 32 of the auxiliary line AL and the power line PL may be disconnected too. The connectors 31 and 32 may be disconnected by cutting the connectors 31 and 32. For example, the cutting may be performed by a laser beam irradiated from a substrate side or a side opposite to a substrate, but is not limited thereto.

As described above, when the dummy pixel DP is coupled to the defective pixel PX' through the auxiliary line AL, a driving current Id output from the dummy pixel DP is transferred to a light-emitting element E of the defective pixel PX' and thus the light-emitting element E normally emits light. To this end, the data driver 130 and the scan driver 120 may provide a data signal and a scan signal to the dummy pixel DP.

The pixel PX will be described below in detail with reference to FIGS. 5A and 5B.

Figure 5A:
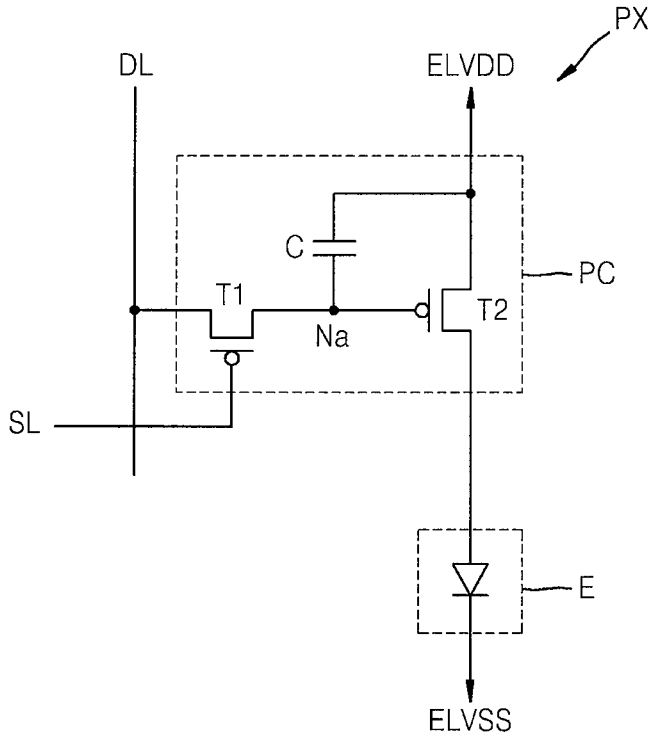
FIG. 5A schematically illustrates an example circuit configuration of a pixel according to an embodiment.

FIG. 5A illustrates an example circuit configuration of the pixel PX according to an embodiment.

Referring to FIG. 5A, the pixel PX includes a light-emitting element E that emits light and a pixel circuit PC that supplies a current to the light-emitting element E. The light-emitting element E may be an organic light-emitting diode (OLED) that includes a first electrode, a second electrode facing the first electrode, and an emission layer between the first electrode and the second electrode, but is not limited thereto. The first electrode and the second electrode may be respectively an anode and a cathode. The pixel circuit PC may include two transistors T1 and T2 and one capacitor C.

The first transistor T1 has a gate electrode coupled to the scan line, a first electrode coupled to the data line, and a second electrode coupled to a first node Na.

The second transistor T2 has a gate electrode coupled to the first node Na, a first electrode receiving the first power voltage ELVDD, and a second electrode coupled to one electrode of the light-emitting element E.

The capacitor C has a first electrode coupled to the first node Na and a second electrode receiving the first power voltage ELVDD.

When a scan signal is supplied from the scan line SL, the first transistor T1 transfers a data signal, which is supplied from the data line DL, to the first electrode of the capacitor C. Accordingly, the capacitor C is charged with a voltage corresponding to the data signal, and a driving current corresponding to the voltage charged into the capacitor C is transferred to the light-emitting element E through the second transistor T2, so that the light-emitting element E emits light. In a digital driving mode, because a level of the data signal is an on-level or an off level, the light-emitting element E emits light by a driving current corresponding to a voltage charged into the capacitor according to the on-level data signal. Thus, the light-emitting element E emits light with a uniform luminance (the uniformity of a light-emitting luminance).

Although FIG. 5A illustrates a 2Tr-1Cap structure in which one pixel PX includes two transistors T1 and T2 and one capacitor C, the structure of the pixel PX is not limited thereto. Thus, in some embodiments, one pixel PX may include two or more thin film transistors and one or more capacitors and may have various structures in which an additional line is further formed or a line is omitted.

Figure 5B:
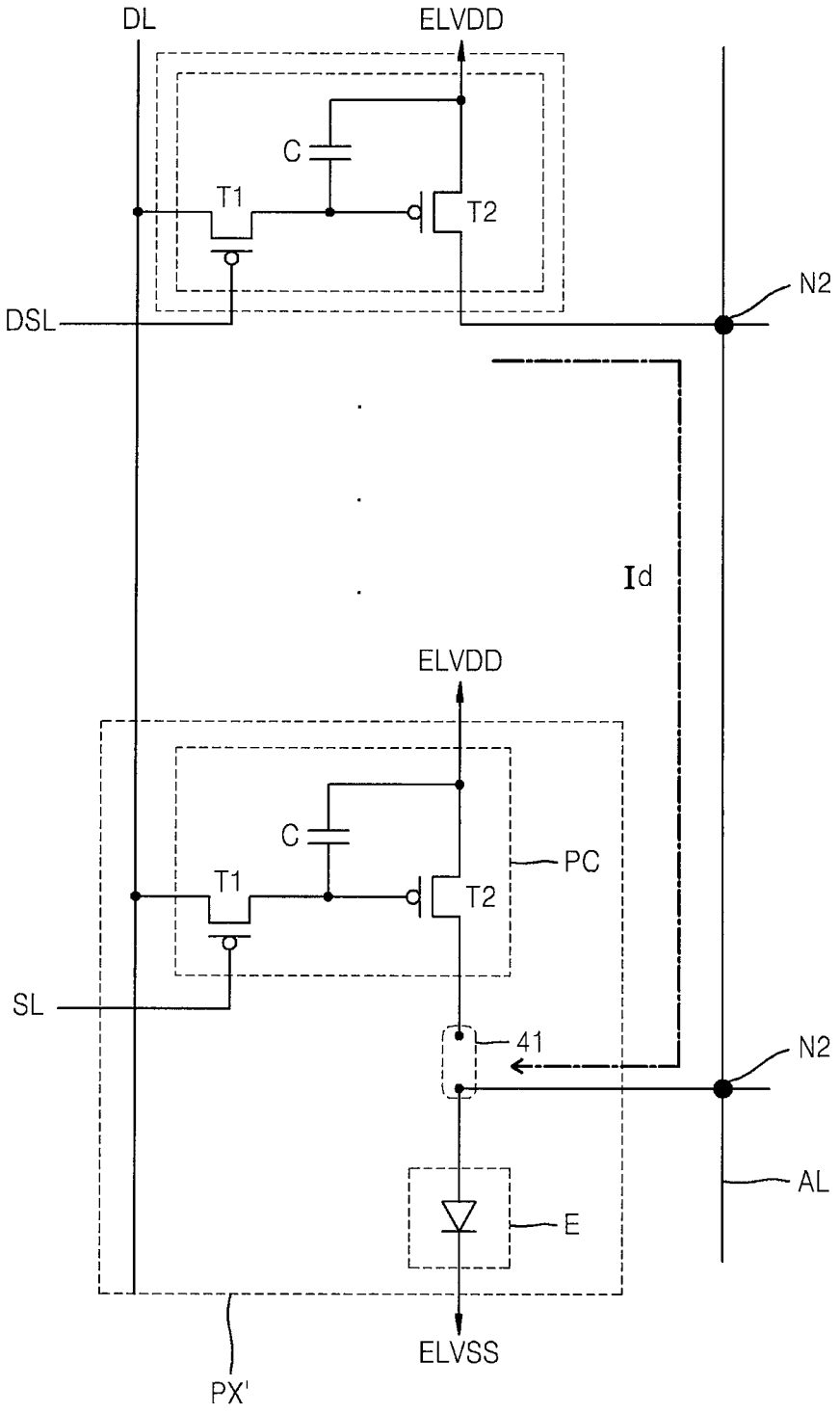
FIG. 5B schematically illustrates a method of repairing a pixel by using a dummy pixel, according to an embodiment.

FIG. 5B schematically illustrates a method of repairing the pixel PX by using the dummy pixel DP, according to an embodiment.

A pixel PX' illustrated in FIG. 5B may be identical to the pixel PX illustrated in FIG. 5A. Thus, in the following description, the contents described above in reference to the pixel PX illustrated in FIG. 5A may be applied to the pixel PX' illustrated in FIG. 5B.

Referring to FIG. 5B, a dummy pixel DP may be disposed in the same column (or row) as the pixel PX' and includes a dummy pixel circuit DPC. The dummy pixel circuit DPC may be identical to or different from the pixel circuit PC.

The dummy pixel circuit DPC includes a first transistor T1 coupled to a dummy scan line DSL and a data line DL, a second transistor T2 coupled between the first power voltage ELVDD and the first transistor T1, and a capacitor C coupled between the first power voltage ELVDD and the first transistor T1. FIG. 5B illustrates an example dummy pixel circuit DPC, and the dummy pixel circuit DPC is not limited thereto. For example, the dummy pixel circuit DPC may include one or more thin film transistors and a capacitor or may have various structures in which the capacitor is omitted.

The dummy scan line DSL may be identical to or different from the scan line SL disposed in the pixel circuit PC, and the data line DL may be identical to or different from the data line DL coupled to the pixel PX'.

In order to repair the defective pixel PX', the light-emitting element E and the pixel circuit PC of the defective pixel PX' are disconnected. For example, the connector 41 between the pixel circuit PC and the light-emitting element E is disconnected. Then, the light-emitting element E is coupled to the dummy pixel circuit DPC of the same column or row through the auxiliary line AL. Accordingly, the light-emitting element E of the pixel PX' may receive a driving current Id from the dummy pixel circuit DPC and normally emit light. The disconnection and connection between elements may be performed, for example, by a laser-based cutting (e.g., disconnecting) or welding (e.g., connecting) process.

Embodiments of the present invention are not limited to the pixel having the above described structure, and may include various pixels in order to repair a bright spot or a dark spot of a defective pixel caused by a pixel circuit defect so that the pixel may emit light without luminance loss.

Figure 6:
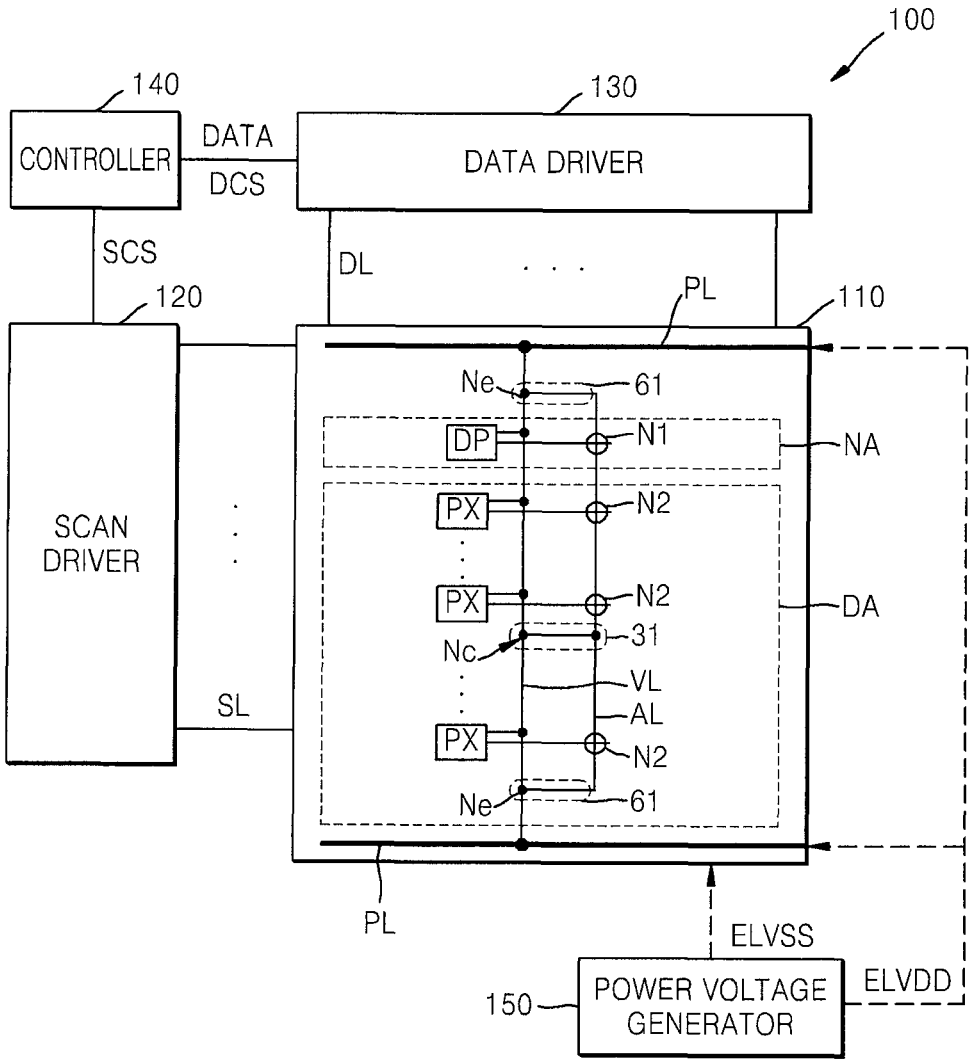
FIG. 6 schematically illustrates an example of the organic light-emitting display apparatus.

FIG. 6 schematically illustrates an example of the organic light-emitting display 100 apparatus.

FIG. 6 illustrates a modification of the organic light-emitting display apparatus 100 illustrated in FIG. 3. FIG. 3 illustrates an example in which both ends of the auxiliary line AL are directly coupled to the power line PL. However, referring to FIG. 6, one end or both ends of the auxiliary line AL may be coupled to one end or both ends of the voltage line VL.

For example, one end or both ends of the auxiliary line AL may be coupled to an edge node Ne of the voltage line VL. The edge node Ne is located at one end or both ends of the voltage line VL. A connector 61 between the edge node Ne and the auxiliary line AL may be disconnectable.

In the embodiment of FIG. 6, the auxiliary line AL is coupled to the edge node Ne of the voltage line VL to receive the power voltage ELVDD applied to an end portion of the voltage line VL through the edge node Ne and apply the power voltage ELVDD to the voltage line VL through the center node Nc.

Figure 7:
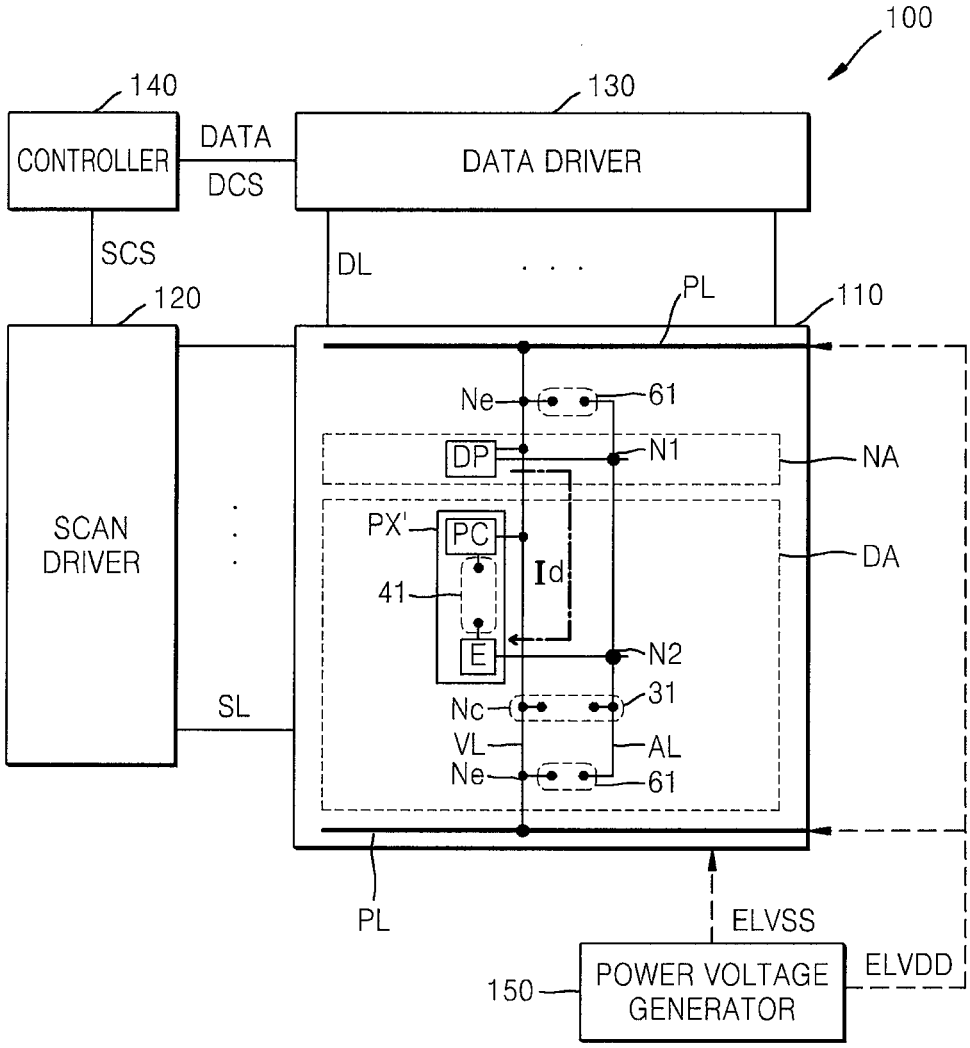
FIG. 7 schematically illustrates a method of repairing a defective pixel in the organic light-emitting display apparatus illustrated in FIG. 6.

FIG. 7 illustrates a method of repairing a defective pixel in the organic light-emitting display apparatus 100 illustrated in FIG. 6.

In the following description, the contents described above in relation to a method of repairing the defective pixel PX' illustrated in FIG. 4 may be applied to a method of repairing the defective pixel PX' illustrated in FIG. 7.

Referring to FIG. 7, when a defective pixel PX' is detected in the display panel 110 illustrated in FIG. 6, the auxiliary line AL may be used to repair the defective pixel PX'. In more detail, a light-emitting element E of the defective pixel PX' is disconnected from the pixel circuit PC, and the light-emitting element E is connected to the dummy pixel DP through the auxiliary line AL. The disconnection of the light-emitting element E from the pixel circuit PC may be performed by cutting a connector 41 between the light-emitting element E and the pixel circuit PC.

The auxiliary line AL couples the disconnected light-emitting element E and the dummy pixel DP. To this end, connectable nodes N1 and N2 are coupled. The connection between the auxiliary line AL and the light-emitting element E and the connection between the auxiliary line AL and the dummy pixel DP may be performed by coupling the connectable nodes N1 and N2. For example, the conductor and the auxiliary line AL may be electrically coupled by welding (e.g., welding out a portion of the insulting layer and welding in an electrical connection) between the conductor and the auxiliary line AL in the connectable nodes N1 and N2.

As illustrated in FIG. 7, when the auxiliary line AL is used to repair the defective pixel PX', the connection between the auxiliary line AL and the voltage line VL may be disconnected. For example, the center node Nc of the voltage line VL and the connector 31 of the auxiliary line AL may be disconnected, and the edge node Ne of the voltage line VL and the connector 61 of the auxiliary line AL may be disconnected. The disconnection of the connectors 31 and 61 may be performed by cutting. For example, the cutting may be performed by a laser beam irradiated from a substrate side or a side opposite to a substrate, but is not limited thereto.

As described above, when the dummy pixel DP is coupled to the defective pixel PX' through the auxiliary line AL, a driving current Id output from the dummy pixel DP is transferred to a light-emitting element E of the defective pixel PX' and thus the light-emitting element E normally emits light. To this end, the data driver 130 and the scan driver 120 may provide a data signal and a scan signal to the dummy pixel DP.

In the example of FIGS. 3 and 4, because the voltage line VL and the auxiliary line AL are coupled through the power line PL, a connection node of the power line and the voltage line may be considered as the edge node Ne.

Embodiment 2

Figure 8:
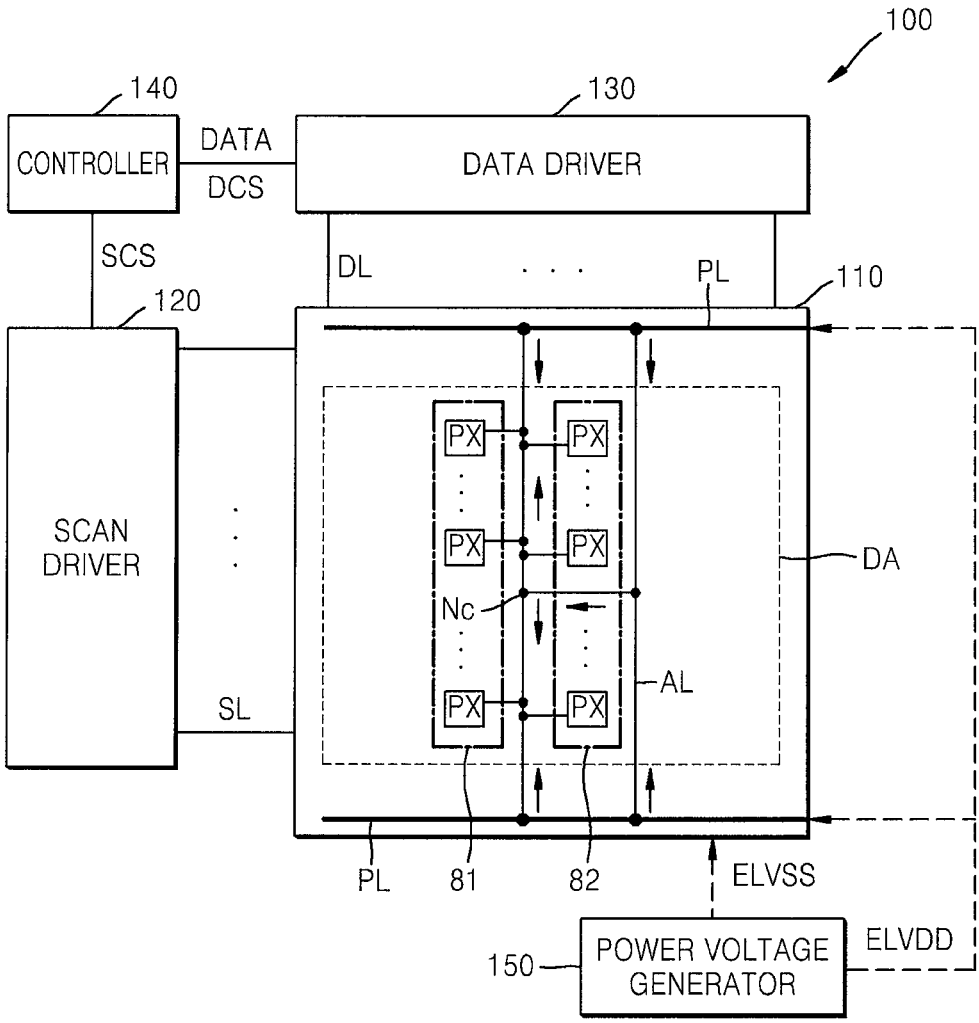
FIG. 8 schematically illustrates an organic light-emitting display apparatus according to an embodiment.

FIG. 8 schematically illustrates an organic light-emitting display apparatus 100 according to an embodiment.

In the example of FIGS. 1 to 7, the voltage line VL is provided corresponding to one pixel column and transfers the power voltage to the pixels PX of the pixel column. However, referring to FIG. 8, the voltage line VL may be provided to correspond to a plurality of pixel columns. The voltage line VL may apply the power voltage to the pixels PX included in the plurality of pixel columns. According to this embodiment, the number of voltage lines VL provided in the display panel 110 may be reduced to increase an aperture ratio.

According to an embodiment, the voltage line VL may be provided for every two adjacent pixel columns. Referring to FIG. 8, the voltage line VL is provided to correspond to a first column 81 and a second column 82 adjacent to the first column 81. The voltage line VL supplies the first power voltage ELVDD to the pixels PX included in the first column 81 and the pixels PX included in the second column 82 adjacent to the first column 81.

Referring to FIG. 8, the auxiliary line AL may also be provided for every two adjacent pixel columns. The auxiliary line AL may be provided to correspond to one voltage line VL. Referring to FIG. 8, the auxiliary line AL may apply the first power voltage ELVDD to the center node Nc of the voltage line VL. Accordingly, because the power line PL is located outside of the display area DA, reduction in the luminance of the center portion of the display panel 110 due to a voltage drop may be reduced or limited.

Referring to FIG. 8, the voltage line VL and the auxiliary line AL may be provided alternately corresponding to the pixel columns. For example, the voltage line VL may be provided in the even-numbered column and the auxiliary line AL may be provided in the odd-numbered column. However, embodiments of the present invention are not limited thereto. According to the described embodiment, one voltage line VL or one auxiliary line AL is provided in one column. That is, because one line is allocated per column, an aperture ratio is not significantly reduced even when both the voltage line VL and the auxiliary line AL compensating for a power voltage level thereof are provided, as compared to the case where one voltage line VL is provided in one column. Because a luminance reduction caused by a voltage drop in the voltage line VL is reduced or limited by the auxiliary line AL, a high aperture ratio is maintained and the uniformity of the light-emitting luminance of the pixels PX is improved.

Figure 9:
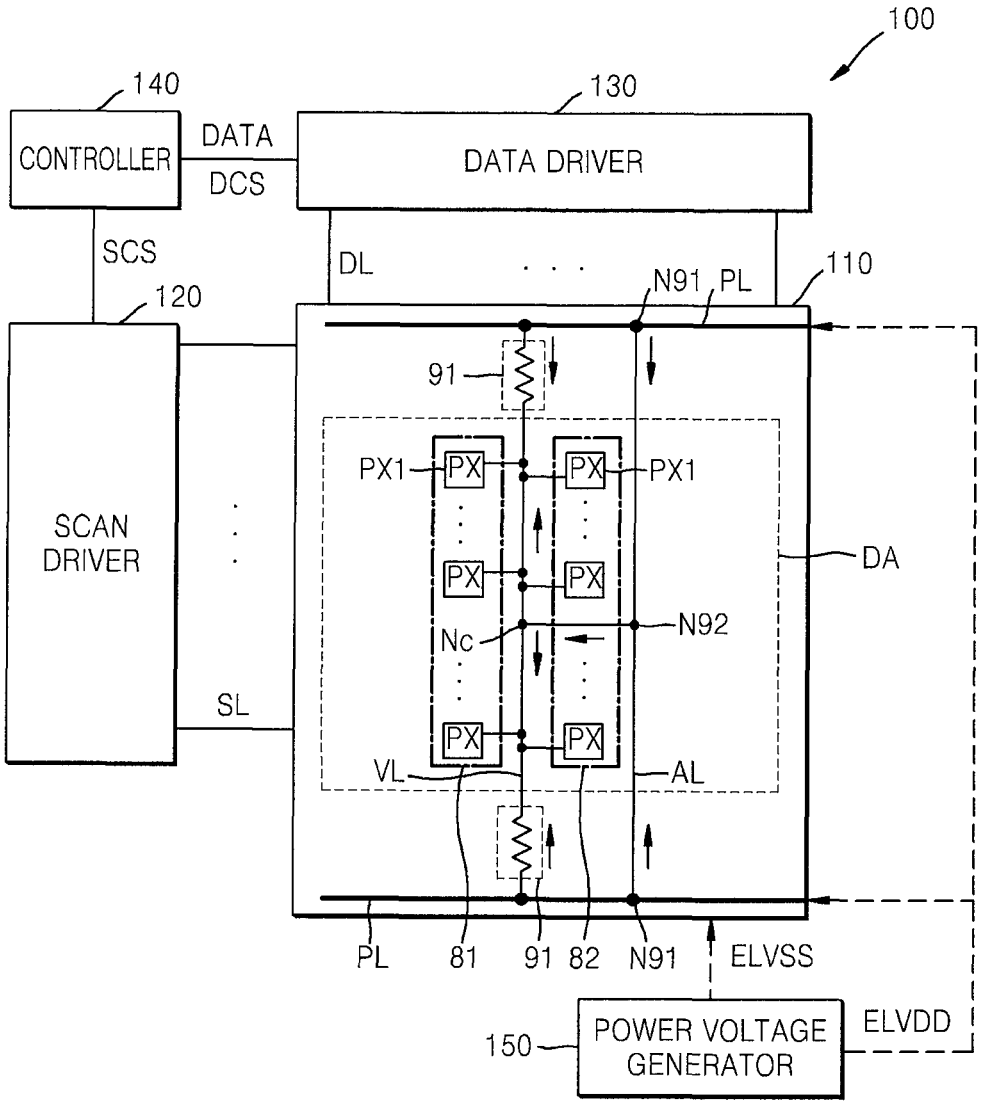
FIG. 9 schematically illustrates a modification of the organic light-emitting display apparatus according to an embodiment.

FIG. 9 illustrates a modification of the organic light-emitting display apparatus 100 according to an embodiment.

Referring to FIG. 9, the voltage line VL may include a circuit element 91 between a portion coupled to the power line PL and a portion coupled to the pixels PX. The circuit element 91 may have a resistance. The resistance of the circuit element 91 corresponds to a resistance between a node N91 coupled to the power line PL on the auxiliary line and a node coupled to the center node Nc.

Due to a voltage drop (hereinafter referred to as a first voltage drop) of the auxiliary line AL when the power voltage ELVDD of the power line PL is transferred to the center node Nc of the auxiliary line AL, a voltage applied to the center node Nc may be lower than the power voltage ELVDD of the power line PL. A voltage drop (hereinafter referred to as a second voltage drop) occurring in the voltage line VL when the power voltage ELVDD of the power line PL is transferred to the first pixel PX1 coupled to the voltage line VL may be smaller than the first voltage drop. Accordingly, the power voltage applied to the first pixel PX1 may be higher than the power voltage applied to the pixel located near the center node Nc. That is, the luminance of the pixels at both ends of the first column may be higher than the luminance of the center pixel.

In order to compensate for this, the voltage line VL according to an embodiment, may include a circuit element 91 at both ends thereof, and a resistance of the circuit element 91 may be determined according to a resistance between the node N91 and the node N92 (or between the node N91 and the center node Nc). In this manner, because the circuit element 91 is provided, the luminance of the center pixel located near the edge of the display panel 110 is uniformized (e.g., more uniform).

FIG. 9 illustrates an embodiment in which the voltage line VL includes the circuit element 91. The voltage line VL may be used in the display panel 110 illustrated in FIGS. 1 to 7.

Figure 10:
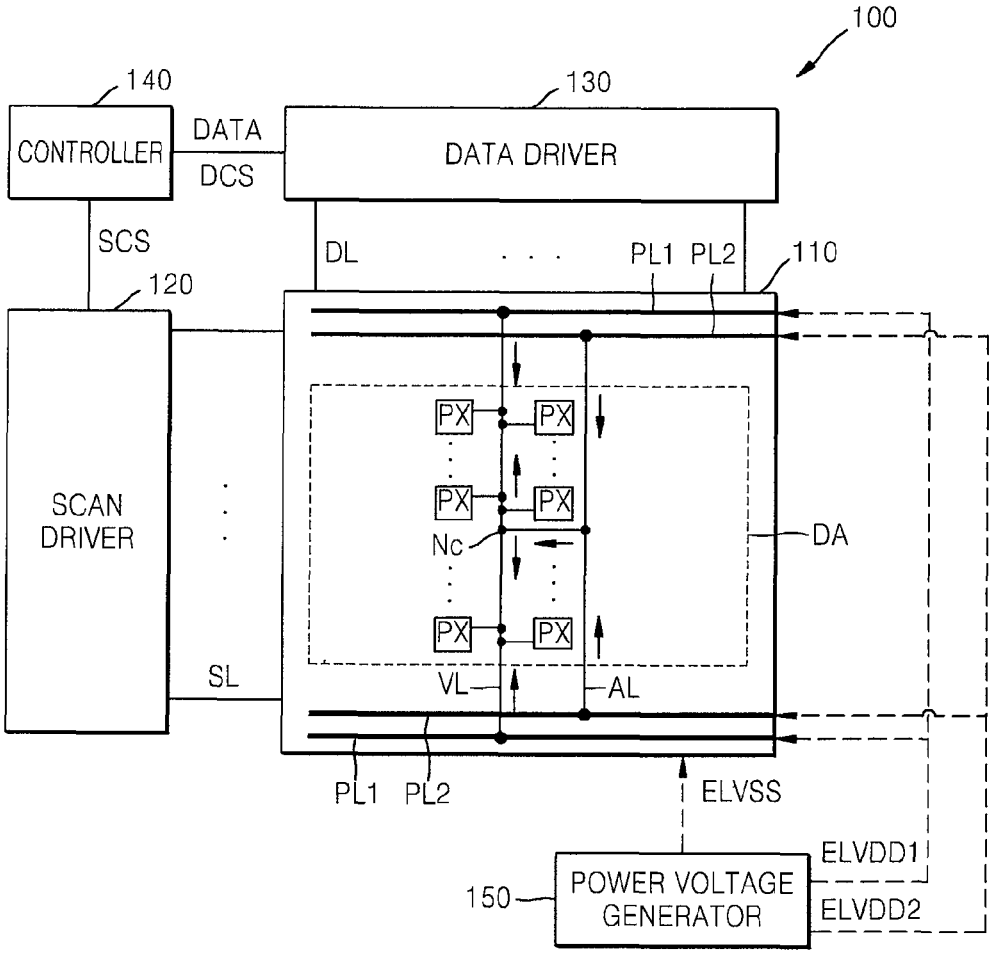
FIG. 10 schematically illustrates another modification of the organic light-emitting display apparatus according to an embodiment.

FIG. 10 illustrates another modification of the organic light-emitting display apparatus 100 according to an embodiment.

FIG. 10 illustrates an example of a display panel 110 in which the luminance of the center pixel located near the edge of the display panel 110 is uniform. Referring to FIG. 10, the voltage line VL and the auxiliary line AL may be coupled to different power lines. For example, the voltage line VL may be coupled to a first power line PL1, and the auxiliary line AL may be coupled to a second power line PL2. The first power line PL1 transfers a first power voltage ELVDD1, and the second power line PL2 transfers a second power voltage ELVDD2.

The power voltage generator 150 may generate two different power voltages ELVDD1 and ELVDD2 and respectively apply the two different power voltages ELVDD1 and ELVDD2 to the first power line PL1 and the second power line PL2. Voltage levels of the two different power voltages ELVDD1 and ELVDD2 may be determined in consideration of a voltage drop on the auxiliary line AL and the voltage line VL.

For example, the second power voltage ELVDD2 may be higher than the first power voltage ELVDD1. A voltage level difference between the second power voltage ELVDD2 and the first power voltage ELVDD1 may correspond to a difference between the first voltage drop occurring in the process where a voltage is transferred from the second power line PL2 to the center node Nc and the second voltage drop occurring in the process where a voltage is transferred from the first power line PL1 to the first pixel PX1. Accordingly, a difference between the power voltage applied to the first pixel PX1 and the power voltage applied to the center node Nc may be reduced or minimized.

As described above, according to the one or more of the above embodiments of the present invention, a luminance deviation due to a voltage drop of a power voltage line is reduced in the organic light-emitting display panel and the organic light-emitting display apparatus.

According to the organic light-emitting display panel, the organic light-emitting display apparatus, and the method of repairing the organic light-emitting display panel according to the embodiments of the present invention, the dummy pixel is used to repair the defective pixel, thereby a normal operation can be performed without changing a bright spot into a dark spot.

It should be understood that the example embodiments described herein should be considered in a descriptive sense and not for purposes of limitation. Descriptions of features or aspects within each embodiment should typically be considered as being available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims and their equivalents.

What is claimed is:

1. An organic light-emitting display panel comprising:

a plurality of pixels arranged at a display area in column and row directions, each of the plurality of pixels being configured to receive power voltage and coupled to a scan line and a data line;

a voltage line associated with a pixel column, the voltage line extending in the column direction, and being configured to apply the power voltage to the plurality of pixels included in the pixel column, one end or both ends of the voltage line coupled to a power line supplying the power voltage and located outside of the display area;

a dummy pixel located outside of the display area; and an auxiliary line coupled to a center node of the voltage line, extending in the column direction, wherein the auxiliary line is associated with the pixel column and is configured to be connectable to the dummy pixel and one pixel of the plurality of pixels included in the pixel column to repair a defective pixel of the pixels to emit light, the center node being located at a middle point of the voltage line, wherein the power voltage supplied from the power line is applied to the voltage line through the center node and through the auxiliary line.

2. The organic light-emitting display panel of claim 1, wherein a connection between the voltage line and the auxiliary line at the center node is disconnectable.

3. The organic light-emitting display panel of claim 2, wherein the auxiliary line is coupled to the power line or an edge node of the voltage line, the edge node being located at one end or both ends of the voltage line, and a connection between the voltage line and the auxiliary line at the edge node or a connection between the power line and the auxiliary line is disconnectable.

4. The organic light-emitting display panel of claim 1, wherein the voltage line is associated with a plurality of pixel columns, the voltage line being configured to apply the power voltage to the plurality of pixels included in the plurality of pixel columns.

5. The organic light-emitting display panel of claim 4, wherein the voltage line is provided as a plurality of voltage lines, each associated with every two adjacent pixel columns of the plurality of columns.

6. The organic light-emitting display panel of claim 5, wherein the auxiliary line is provided as a plurality of auxiliary lines, and wherein the plurality of voltage lines and the plurality of auxiliary lines are provided alternately for the plurality of pixel columns.

7. The organic light-emitting display panel of claim 1, wherein the auxiliary line is coupled to the voltage line at an edge node, the edge node being located at one end of the voltage line, and wherein the auxiliary line is configured to supply a voltage of the edge node to the voltage line through the center node.

8. The organic light-emitting display panel of claim 1, wherein the auxiliary line has a lower linear resistance than the voltage line.

9. The organic light-emitting display panel of claim 8, wherein the auxiliary line is thicker than the voltage line.

10. The organic light-emitting display panel of claim 1, wherein the voltage line comprises a circuit element between the power line and the plurality of pixels, and the circuit element has a resistance.

11. The organic light-emitting display panel of claim 10, wherein the resistance of the circuit element corresponds to a resistance between a node coupled to the center node and a node coupled to the power line at an intersection of the power line and the auxiliary line.

12. The organic light-emitting display panel of claim 1, further comprising:

a power voltage generator configured to provide the power voltage to the power line.

13. The organic light-emitting display panel of claim 12, wherein the power voltage generator is configured to generate a first power voltage and a second power voltage, and provide the first power voltage to a first power line, and provide the second power voltage to a second power line, the voltage line is configured to receive the first power voltage from the first power line, and the auxiliary line is configured to receive the second power voltage from the second power line.

14. The organic light-emitting display panel of claim 13, wherein the second power voltage is higher than the first power voltage.

15. The organic light-emitting display panel of claim 14, wherein a difference between the first power voltage and the second power voltage corresponds to a voltage drop at the auxiliary line when the power voltage is transferred from the power line to the center node.

16. A method of repairing an organic light-emitting display panel comprising a plurality of pixels arranged at a display area in column and row directions, the plurality of pixels being configured to receive power voltages; a dummy pixel located outside of the display area; a voltage line associated with a pixel column, the voltage line extending in the column direction and being configured to apply a power voltage to the plurality of pixels included in the pixel column, the power voltage being supplied from a power line through the voltage line; and an auxiliary line coupled to a center node of the voltage line, extending in the column direction, and configured to repair a defective pixel of the pixels, wherein the power voltage supplied from the power line is applied to the voltage line through the center node and through the auxiliary line, wherein the auxiliary line is configured to couple the dummy pixel and one of the plurality of pixels included in the pixel column, the center node being located at a middle point of the voltage line, the method comprising:

disconnecting a pixel circuit from a light-emitting element of a defective pixel from among the plurality of pixels;

coupling the auxiliary line with the light-emitting element of the defective pixel;

applying a same data signal to the dummy pixel and the defective pixel coupled to the auxiliary line;

coupling a dummy pixel circuit of the dummy pixel to the auxiliary line; and disconnecting a connection between the auxiliary line and the voltage line at the center node.

17. The method of claim 16, further comprising applying a data signal to the dummy pixel coupled to the auxiliary line to supply a driving current corresponding to the data signal to the light-emitting element of the defective pixel through the auxiliary line.

18. The method of claim 16, wherein the auxiliary line is coupled to the power line, the method further comprising disconnecting a connection between the power line and the auxiliary line.

19. An organic light-emitting display panel comprising:

a plurality of pixels arranged at a display area in column and row directions, each of the plurality of pixels being configured to receive power voltage and coupled to a scan line and a data line;

a dummy pixel located outside of the display area and including a dummy pixel circuit;

a first voltage line associated with a first pixel column, the first voltage line extending in the column direction, and being configured to apply the power voltage to the plurality of pixels included in the first pixel column, the voltage line coupled to a power line supplying the power voltage and located outside of the display area;

a first auxiliary line coupled to a center node of the first voltage line and parallel with the first voltage line, the center node being located at a middle point of the first voltage line, wherein the power voltage supplied from the power line is applied to the first voltage line through the center node and through the first auxiliary line;

a second voltage line associated with a second pixel column, the second voltage line extending in the column direction, and being configured to apply the power voltage to the plurality of pixels included in the second pixel column, the voltage line coupled to the power line; and a second auxiliary line parallel with the second voltage line and coupled to the dummy pixel circuit and a light-emitting element of a defective pixel of the pixels to repair the defective pixel to emit light.

* * * * *